United States Patent [19]

Wetsel

[11] Patent Number: 4,811,533

[45] Date of Patent: Mar. 14, 1989

[54] WINDOW TRIM SYSTEM

[76] Inventor: John L. Wetsel, P.O. Box 8, Diamond Springs, Calif. 95619

[21] Appl. No.: 98,284

[22] Filed: Sep. 18, 1987

[51] Int. Cl.[4] ..... E06B 1/04

[52] U.S. Cl. ..... 52/211; 52/212; 52/217; 52/287

[58] Field of Search ..... 52/204, 211, 212, 213, 52/215, 217, 311, 273, 276, 287, 716–718; 49/504, 505

[56] References Cited

U.S. PATENT DOCUMENTS

| | | | |
|---|---|---|---|
| 395,945 | 1/1889 | Boda | 52/211 |
| 2,175,909 | 1/1939 | Nelson . | |
| 2,504,700 | 7/1946 | Krantz . | |
| 2,678,476 | 8/1946 | Carter . | |
| 2,698,072 | 10/1950 | Beck . | |
| 2,710,431 | 3/1951 | Griffon . | |
| 2,736,930 | 10/1953 | Longley . | |
| 3,100,320 | 8/1963 | Frederick | 52/211 |
| 3,245,124 | 11/1963 | Faske . | |
| 3,449,873 | 6/1969 | Damato et al. | 52/211 X |
| 3,583,114 | 6/1971 | Belfor | 52/217 |
| 4,193,238 | 3/1980 | Chalmers et al. | 52/211 |
| 4,272,931 | 6/1981 | Stanizzo . | |
| 4,341,048 | 7/1982 | Minter . | |
| 4,389,824 | 6/1983 | Anderson | 52/211 |
| 4,391,072 | 7/1983 | Moore | 52/211 |
| 4,589,229 | 5/1986 | Warren . | |

FOREIGN PATENT DOCUMENTS

| | | | |
|---|---|---|---|
| 1912361 | 9/1970 | Fed. Rep. of Germany | 52/212 |
| 2839589 | 3/1980 | Fed. Rep. of Germany | 52/211 |

*Primary Examiner*—David A. Scherbel
*Assistant Examiner*—Richard E. Chilcot, Jr.
*Attorney, Agent, or Firm*—Gordon L. Peterson; Loyal M. Hanson

[57] ABSTRACT

A window trimming construction includes a trim portion dimensioned and arranged to cover a portion of a surface of a wall in a position circumscribing a window opening extending through the wall that is defined by a window framing. The window trimming construction also includes a molding portion dimensioned and arranged to cover a portion of the window framing disposed intermediate the surface of the wall and a metal frame mounted on the window framing. The molding portion is arranged to enable adjustment of its width according to an amount by which the metal frame is recessed. One embodiment includes a molding portion having a plurality of sections that each cover a corresponding plurality of sections of the window framing, each one of the molding sections having first and second strips joined together with an adjustable joint that enables adjustment of the width.

9 Claims, 1 Drawing Sheet

WINDOW TRIM SYSTEM

BACKGROUND OF THE INVENTION

1. Technical Field

This invention relates generally to window construction, and more particularly to a new and improved trim system for windows such as those having an aluminum frame.

2. Background Information

Windows with a frame composed of a metal alloy such as aluminum, sometime called aluminum windows, provide a welcome degree of durability and ease of installation at reasonable expense. Available in various standard sizes, they mount conveniently within a window opening to facilitate new building construction as well as older building refurbishment. Thus, these windows enjoy widespread use, and the details of their design and installation are of recognized significance.

One problem, however, is the somwhat plain appearance the metal frame may present. The window may be more functional than decorative and fail to complement other attractive aspects of the building. Consequently, it is desirable to have some way of alleviating this concern in a comparatively inexpensive and convenient manner.

Although known carpentry techniques enable the construction of customized trimming around the window, dimensional differences may complicate doing so. One difference in particular relates to the amount by which the metal frame is recessed within the window opening. In this regard, conventional window framing may define a rectangularly shaped window opening that extends through a wall between inside and outside wall surfaces. The metal frame of the window is mounted on the window framing by such means as nails or screws so that it is set back from the wall surface, recessed within the window opening. However, the amount of recess may be different for different windows. As a result, the trimming must be carefully customized for any one window according to the amount of recess.

A portion of the window trimming may be installed on the inside surface of the wall in the coventional form of either a picture frame configuration or a stool and apron configuration (the latter having a sill). These and related configurations generally consist of what may be called a trim portion and a molding portion. The trim portion lies against the surface of the wall, the inside surface for example, to circumscribe the window opening. In this position, it defines or frames a revealed area of the window.

The molding portion is installed over the window framing in a position extending from the trim portion to the metal frame of the window. Here, it covers a portion of the window framing intermediate the wall surface and the metal frame. In other words, the trim portion covers an otherwise exposed area of the inside wall surface, and the molding portion covers an otherwise exposed area of the window framing. Of course, similar window trimming can also be provided for the outside wall surface.

The problem caused by differences in the amount that the metal frame is recessed stems from the desire to fully line the window framing between the trim portion and the metal frame. To do so provides a more attractive, finished appearance, but it also means cutting the molding portion to a width corresponding to the precise amount that the metal frame is recessed from the trim portion.

Typically, the molding portion may include a first section that covers a horizontally disposed upper section of the window framing, second and third section that cover vertically disposed side sections of the window framing, and, in the case of a picture frame configuration, a fourth section that covers a horizontally disposed lower section of the window framing. These may be strips of wood, for example, and cutting or shaving the width of each of these strips to the required dimension involves added time and inconvenience that may significantly increase project costs.

Consequently, it is desirable to have a new and improved window trim system for improving the appearance of windows in a manner alleviating these concerns--one that reduces the carpentry skill involved to provide a comparatively inexpensive and convenient installation, and more particularly, one better able to accommodate dimensional differences in the amount the metal frame is recessed.

SUMMARY OF THE INVENTION

This invention recognizes the problems associated with the prior art and provides a new and improved window trim system with the desired attributes.

Briefly, the above and further objects of the present invention are realized by providing a window trimming construction having a molding portion with an adjustable width. Thus, window appearance can be dramatically improved with a construction that reduces the carpentry skill involved. The window trimming is comparatively inexpensive, it is convenient to install, and it is better able to accommodate dimensional differences in the amount the metal frame is recessed.

Generally, a window trimming construction according to the invention includes a trim portion dimensioned and arranged to cover a portion of a surface of a wall in a position circumscribing a window opening extending through the wall that is defined by a window framing. The trim portion can be arranged in various configurations, including a conventional picture frame configuration or a stool and apron configuration. In one form, for example, the trim portion may include a plurality of sections arranged in a rectangular configuration that extends around the periphery of the window opening.

The window trimming construction also includes a molding portion that is dimensioned and arranged to cover a portion of the window framing diposed intermediate the surface of the wall and a metal frame mounted on the window framing. According to a major aspect of the invention, the molding portion is arranged to enable the width to be adjusted according to an amount by which the metal frame is recessed from the surface of the wall.

For this purpose, the molding portion of one embodiment includes a plurality of sections to be used in covering a corresponding plurality of sections of the window framing. Each one of the sections of molding includes first and second strips joined together with an adjustable joint that enables adjustment of the width. Thus, the molding portion readily accommodates differences in the amount of the metal frame is recessed.

The method of the invention includes constructing a trim portion and a molding portion. The molding portion is constructed so that the width of the molding portion can be adjusted according to an amount by which the metal frame is recessed from the surface of the wall, and this may be done with a tongue-and-groove joint.

Next, the trim portion is mounted on the wall in a position circumscribing the window opening, and each one of the sections of the molding portion is placed over a respective one of the sections of the window framing in a position intermediate the trimming portion and the metal frame. The width of each one of the sections of the molding portion is then adjusted according to the amount by which the metal frame is recessed so that each one of the sections of the molding portion extends from the trimming portion of the metal frame.

Next, each one of the sections of the molding portion is attached to the window framing. This is done by nailing through the groove portion of each one of the second strips and the tongue portion of each one of the first strips. As a result, the width of each one of the sections of the molding portion is retained at a desired size.

The above mentioned and other objects and features of this invention and the manner of attaining them will become apparent, and the invention itself will be best understood, by reference to the following description taken in conjunction with the accompanying illustrative drawings,

DESCRIPTION OF THE PREFERRED EMBODIMENTS

Figure 1:
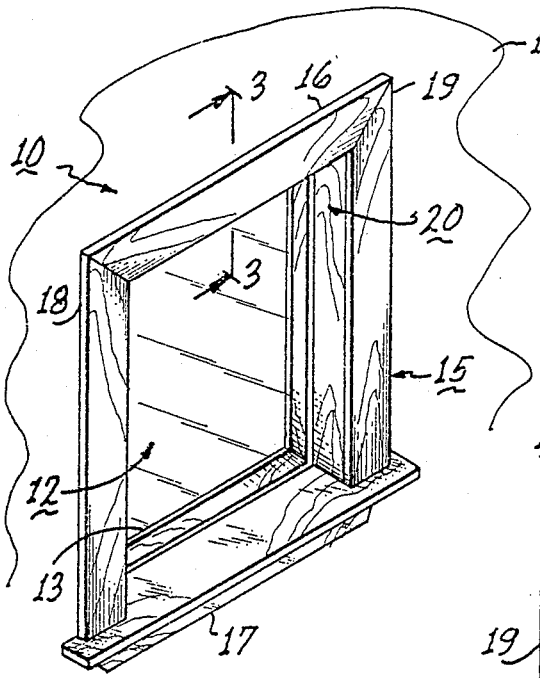
FIG. 1 of the drawings is a perspective view of installed trimming constructed according to the invention.

Referring now to the drawings, there is shown a new and improved window construction or timming 10 that is constructed according to the invention. The trimming 10 is mounted on a wall surface 11 to enhance the appearance of a conventional aluminum window 12 of the type having a frame, such as metal frame 13 (FIG. 1). The window 12 is mounted within a window opening defined by a conventional window framing 14 (FIGS. 3 and 4) by mounting the metal frame 13 on the window framing 14 utilizing such suitable means as nails or screws (not shown).

Although the illustrated trimming 10 is constructed in a stool and apron configuration, the inventive concepts disclosed are equally applicable to other configurations, such as a picture frame configuration. In addition, the method and structure of the invention may be used for installations using other than a metal frame. In this regard, use of the term "metal frame" is intended to emphasize use of the invention with conventional aluminum windows while applying broadly to frames having other compositions so that use with such other frames also falls within the scope of the claims.

Figure 3:
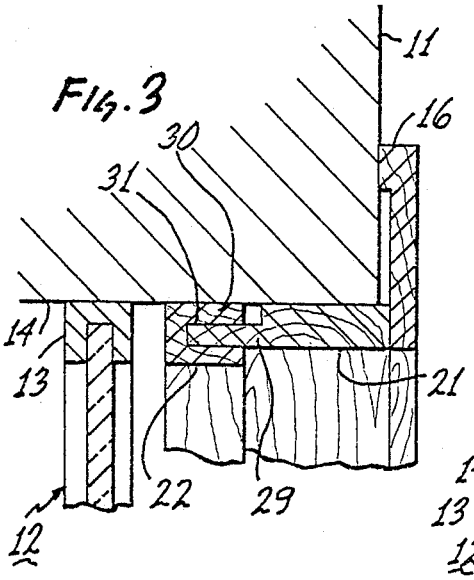
FIG. 3 is an enlarged view of a portion of the trimming taken in cross section on line 3—3 of FIG. 1 before adjustment of the molding portion.
Figure 4:
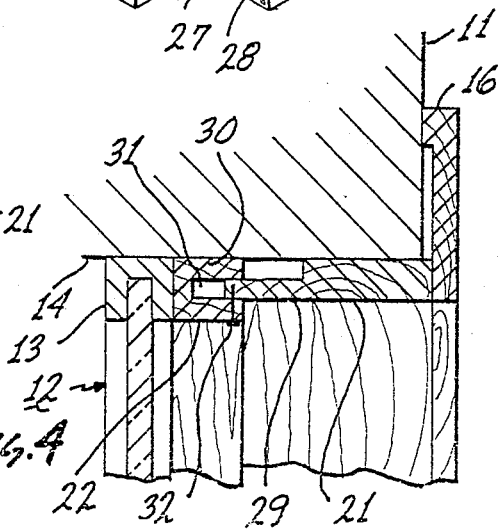
FIG. 4 is a cross sectional view similar to FIG. 3, showing the fully installed position of the molding portion.

The major aspect of the invention concerns variation between window installations in the amount the metal frame 13 is recessed from the wall surface 11. A recess of approximately five inches or so is depicted in FIGS. 3 and 4, and the trimming 10 is arranged to be adjusted during installation in order to accommodate the precise amount of recess.

Generally, the trimming 10 includes a trim portion 15 having upper and lower horizontal sections 16 and 17, and left and right vertical sections 18 and 19 (FIG. 1). The sections 16–19 are dimensioned and arranged to cover a portion of the surface 11 in a position circumscribing the window 12. So arranged, they define a revealed area of the window 12 while covering a portion of the wall surface 11, the revealed area being the portion of the window 12 that is still visible after the trimming 10 is installed. Each one of the sections 16–19 may be a length of decorative wood that is mounted on the wall surface 11 by suitable means such as nails.

Figure 2:
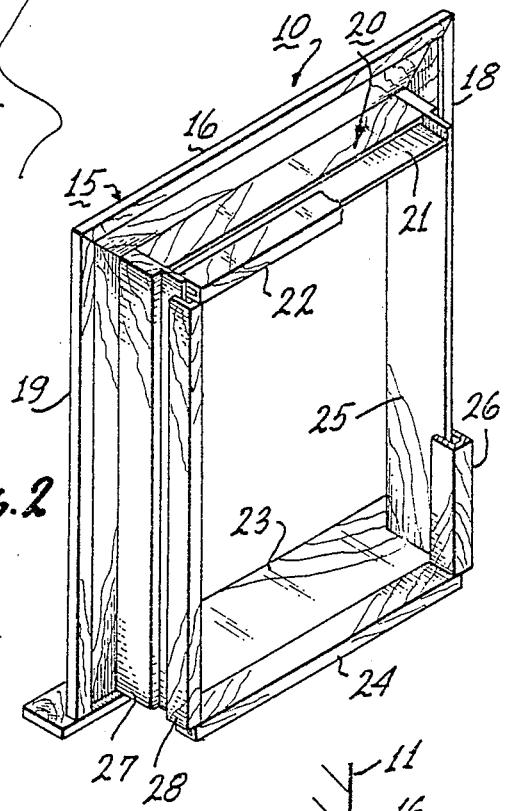
FIG. 2 is a perspective view of the rear side of the trimming before installation.

The trimming 10 also includes a molding portion 20 disposed intermediate the trim portion 15 and the metal frame 13 (FIG. 1). In this position, the molding portion 20 covers a portion of the window framing 14. An upper section of the molding portion 20 includes first and second strips 21 and 22 (FIG. 2), and these are joined together adjustably in order to enable the width of the molding portion 20 to be adjusted to generally match the amount the metal frame 13 is recessed. Similarly, a lower section of the molding portion 20 includes first and second strips 23 and 24 that are joined together adjustably (FIG. 2). However, the first strip 23 is in the form of a window sill in the illustrated trimming 10, whereas it would take a form similar to that of the strip 21 in a picture frame configuration.

In a similar manner, a left section of the molding portion 20 includes first and second strips 25 and 26, and a right section of the molding portion 20 includes first and second strips 27 and 28. The strips 21–28 may be wooden strips that can be nailed to the window framing 14, and they are configured to be join together adjustably during installation of the trimming 10. They are generally similar in the type of adjustable joint they provide so that only the first and second strips 21 and 22 are described in further details in this respect.

As illustrated in FIGS. 3 and 4, the strip 21 includes a longitudinally-extending tongue portion 29, and the strip 22 has a longitudinally-extending groove portion 30 dimensioned and arranged with a generally U-shaped cross section to define a longitudinally-extending groove 31 in which the tongue portion 29 fits adjustably. Thus, the strips 21 and 22 provide an adjustable joint and serve as variable width means for enabling the width of the molding portion 20 to be adjusted according to an amount by which the metal frame 13 is recessed from the wall surface 11.

The first strip 21 is dimensioned and arranged to extend from the trim portion 15 toward the metal frame 13, and the second strip 22 is dimensioned and arranged to extend from the first strip 21 to the metal frame 13. The first and second strips 21 and 22 are first positioned as illustrated in FIG. 3, and then they are spread until the second strip 22 abuts the metal frame 13. Once adjusted in this manner, a nail 32 (FIG. 4) is driven through the tongue portion 29 and the groove portion 30 into the window framing 14, and this retains the strips in the adjusted position.

Construction according to the invention of window trimming proceeds by constructing a trim portion so that it is dimensioned and arranged to cover a portion of the wall surface in a position circumscribing the window. Construction includes constructing a molding portion so that it is dimensioned and arranged to cover a portion of the window framing disposed intermediate the wall surface and the metal frame. This is done so that the width of the molding portion can be adjusted according to the amount by which the metal frame is recessed from the wall surface.

With respect to the trimming 10, this is done by constructing the molding portion 20 to include a plurality of sections to be used in covering a corresponding plurality of sections of the window framing so that each one of the sections of the molding portion includes first and second strips joined together with an adjustable joint that enables adjustment of the width. These are the strips 21–28 mentioned above.

One these components are constructed, the trim portion 15 is mounted on the wall surface 11 in a position circumscribing the window 12, and the strips 21–28 are placed over respective sections of the window framing 14 in a position intermediate the trim portion 15 and the metal frame 13. This results in the component position illustrated in FIG. 3. Next, the width of the molding portion 20 is adjusted according to the amount by which the metal frame 13 is recessed so that the molding portion 20 extends from the trim portion 15 to the metal frame 13. Then, the molding portion 20 is attached to the window framing by nailing as described above, to result in the component position illustrated in FIG. 4.

Thus, the invention provides a new and improved window trimming construction that dramatically improves appearance with a construction requiring little carpentry skill. The window trimming is comparatively inexpensive, it is convenient to install, and it is better able to accommodate dimensional difference in the amount the metal frame is recessed.

Although an exemplary embodiment of the invention has been shown and described, many changes, modifications, and substitutions may be made by one having ordinary skill in the art without necessarily departing from the spirit and scope of this invention.

What is claimed is:

1. A window trimming construction suitable for use with a metal frame mounted on a wall framing that defines a window opening in a wall, the window trimming construction comprising:

a trim portion having upper and lower horizontal sections and left and right vertical sections that are dimensioned, arranged, and interconnected to cover a portion of a surface of the wall in a position circumscribing the window opening;

a molding portion having upper and lower horizontal sections and left and right vertical sections that are dimensioned and arranged to cover a portion of the window framing that is disposed intermediate the surface of the wall and the metal frame; and variable width means for enabling the width of the molding portion to be adjusted according to an amount by which the metal frame is recessed from the surface of the wall;

the variable width means including each of the horizontal and vertical sections of the molding portion including first and second strips joined together adjustably in order to enable the width of the molding portion to be adjusted to generally match the amount the metal frame is recessed from the surface of the wall;

the first strip of each section being attached to a respective one of the horizontal and vertical sections of the trim portion and including a longitudinally extending tongue portion that extends toward the metal frame;

the second strip of each section having a longitudinally extending groove portion in which the tongue portion of the first strip of said section fits adjustably; and the longitudinally extending groove portion having a width less than the amount the metal frame is recessed from the surface of the wall so that the second strip does not extend out of the window opening beyond the surface of the wall.

2. A window trimming construction as recited in claim 1, wherein:

the molding and trim portions are arranged in a stool and apron configuration.

3. A window trimming construction as recited in claim 2, wherein:

the second strip has a generally U-shaped cross section.

4. A window trimming construction as recited in claim 2, wherein:

the first and second strips of each one of the sections of the molding portion are composed of a wooden material.

5. A window trimming construction suitable for use with a metal frame mounted on a wall framing that defines a window opening in a wall, the window trimming construction, comprising:

a trim portion having upper and lower horizontal sections and left and right vertical sections that are dimensioned arranged to cover a portion of a surface of the wall in a position circumscribing the window opening;

a molding portion having upper and lower horizontal sections and left and right vertical sections that are dimensioned and arranged to cover a portion of the window framing that is disposed intermediate the surface of the wall and the metal frame; and variable width means for enabling the width of the molding portion to be adjusted according to an amount by which the metal frame is recessed from the surface of the wall;

the molding and trim portions having a stool and apron configuration that can be installed in the window opening; and the variable width means including each of the horizontal and vertical sections of the molding portion including first and second strips joined together adjustably in order to enable the width of the molding portion to be adjusted to generally match the amount the metal frame is recessed from the surface of the wall;

the first strip of each section extending from the surface of the wall into the window opening and including a longitudinally extending tongue portion that extends toward the metal frame;

the second strip of each section having a longitudinally extending groove portion in which the tongue portion of the first strip of said section fits adjustably; and the longitudinally extending groove portion having a width less than the amount the metal frame is recessed from the surface of the wall so that the second strip does not extend out of the window opening beyond the surface of the wall.

6. A window trimming construction as recited in claim 5, wherein:

the first strip of the lower horizontal section of the molding section has a window sill configuration.

7. A method of constructing a window trimming suitable for use with a metal frame mounted on a wall framing that defines a window opening in a wall, the method comprising:

constructing a trim portion that is dimensioned and arranged to cover a portion of a surface of the wall in a position circumscribing the window opening;

constructing a molding portion having first and second horizontal sections and first and second vertical sections that are dimensioned and arranged to cover a portion of the window framing disposed intermediate the surface of the wall and the metal frame so that each section of the molding portion includes first and second strips, the first strip of each section being dimensioned and arranged to extend from the surface of the wall into the window opening and including a longitudinally extending tongue portion that is dimensioned and arranged to extend toward the metal frame and the second strip of each section having a longitudinally extending groove portion in which the tongue portion of the first strip of said section fits adjustably;

placing the trim portion against the surface of the wall with the molding portion within the window opening; and moving each of the second strips so that they abut the metal frame.

8. A window installation, comprising:

a wall framing that defines a window opening in a wall;

a metal frame mounted on the wall framing within the window opening, which metal frame is recessed a fixed distance from a surface of the wall;

a window trimming construction having a trim portion, a molding portion, and varaible width means for enabling the width of the molding portion to be adjusted according to the distance by which the metal frame is recessed;

the trim portion having upper and lower horizontal sections and left and right vertical sections that are dimensioned and arranged to cover a portion of a surface of the wall in a position circumscribing the window opening;

the molding portion having upper and lower horizontal sections and left and right vertical sections that are dimensioned and arranged to cover a portion of the window framing that is disposed intermediate the surface of the wall and the metal frame; and the variable width means including each of the horizontal and vertical sections of the molding portion including first and second strips joined together adjustably in order to enable the width of the molding portion to be adjusted to generally match the distance the metal frame is recessed from the surface of the wall;

the first strip of each section extending from the surface of the wall into the window opening and including a longitudinally extending tongue portion that extends toward the metal frame;

the second strip of each section having a longitudinally extending groove portion in which the tongue portion of the first strip of said section fits adjustably; and the longitudinally extending groove portion having a width less than the amount the metal frame is recessed from the surface of the wall so that the second strip does not extend out of the window opening beyond the surface of the wall.

9. A window installation as recited in claim 8, wherein:

the molding and trim portions are arranged in a stool and apron configuration.

* * * * *